US006098285A

United States Patent [19]

Tsuji

[11] Patent Number: 6,098,285

[45] Date of Patent: Aug. 8, 2000

[54] CRIMPING METHOD FOR PRODUCING A CHAINED TERMINAL

[75] Inventor: Masanori Tsuji, Shizuoka, Japan

[73] Assignee: Yazaki Corporation, Tokyo, Japan

[21] Appl. No.: 09/231,370

[22] Filed: Jan. 13, 1999

Related U.S. Application Data

[62] Division of application No. 08/951,211, Sep. 19, 1997, abandoned.

[30] Foreign Application Priority Data

Sep. 19, 1996 [JP] Japan ..... 8-248136

[51] Int. Cl.[7] ..... H01R 43/04

[52] U.S. Cl. ..... 29/863; 29/861; 29/882

[58] Field of Search ..... 29/825, 857, 863, 29/874, 882, 861; 22/409.14

[56] References Cited

U.S. PATENT DOCUMENTS 2,727,299 12/1955 Klumpp, Jr. ..... 29/874

4,018,177 4/1977 McKee et al. ..... 113/119

4,466,689 8/1984 Davis et al. ..... 339/263 R

FOREIGN PATENT DOCUMENTS 1-175188 7/1999 Japan .

*Primary Examiner*—Lee Young

*Assistant Examiner*—Bobby Rushing

*Attorney, Agent, or Firm*—Morgan, Lewis & Bockius LLP

[57] ABSTRACT

In a chained terminal, plural male terminals each of which is provided with an electric contact part and an electric wire connecting part, are arranged at a predetermined interval on both sides of a feed plate in a staggered layout. A pair of terminal crimping machines are arranged in positions in which they are separated by a pitch between adjacent male terminals on both sides of the feed plate, and an electric wire is alternately crimped and fixed to each male terminal on both sides of the feed plate by each terminal crimping machine, while feeding the chained terminal by the half of the pitch between adjacent male terminals.

1 Claim, 5 Drawing Sheets

CRIMPING METHOD FOR PRODUCING A CHAINED TERMINAL

This is a divisional of application Ser. No. 08/951,211 filed on Sep. 19, 1997 now abandoned.

BACKGROUND OF THE INVENTION

The present invention relates to a chained terminal wherein plural connection terminals are formed at a predetermined interval on a feed plate, and a crimping method using the same.

Heretofore, as means for sequentially crimping respective connection terminals to a number of electric wires by using a terminal crimping machine, a chained terminal wherein connection terminals are formed at a predetermined interval on one side of a feed plate is used, as disclosed in Japanese Unexamined Patent Publication No. Hei. 6-275363 and No. Hei. 7-45321.

In the above chained terminal, connection terminals in each of which an electric contact part and an electric wire connecting part are bent to be formed, are arranged in parallel at a predetermined interval on one side of a feed plate by punching and pressing terminal metal material, which has been obtained by punching a metallic thin plate in a developed state, by the progressive working of a press and the like.

Plural electric wires are sequentially crimped and fixed to each connection terminal by feeding the feed plate of the above chained terminal by a predetermined pitch, that is, by a pitch between adjacent terminals by a terminal feed mechanism, sequentially locking an electric wire in the electric wire connecting part of the connection terminal by the terminal crimping machine, and cutting a predetermined location of a part connected to the feed plate.

That is, plural electric wires can be sequentially crimped and fixed to the respective connection terminals at high speed by using the chained terminal so that mass production is enabled.

However, in a conventional type chained terminal, since a feed plate is wasted after an electric wire is crimped and fixed to each connection terminal and the connection terminal is cut, much unnecessary material is used and the method is not efficient.

Also, since an electric wire is crimped and fixed to each connection terminal, while feeding the feed plate by a predetermined pitch forward by the terminal crimping machine by using the above chained terminal, the feed rate of a terminal feed mechanism is required to be speeded up to operate the terminal crimping machine at high speed to enhance productive efficiency.

However, the feed pitch of the above terminal feed mechanism is determined by a pitch between adjacent terminals and the pitch cannot be reduced according to the speedup of the feed rate. When the feed rate of the terminal feed mechanism is speeded up, a feed by the terminal feed mechanism driven via many followers is imprecise, so that a problem that the connection terminal is not crimped to an electric wire and an electric wire is damaged is caused.

SUMMARY OF THE INVENTION

Therefore, the present invention has been made to solve the above problem and an object is to provide a chained terminal and a crimping method wherein unnecessary material is reduced and productive efficiency can be enhanced.

The above object of the present invention is achieved by a chained terminal characterized in that plural connection terminals each of which is provided with an electric contact part and an electric wire connecting part are arranged at a predetermined interval on both sides of a feed plate in a staggered layout.

Also, the above object of the present invention is achieved by a crimping method of a chained terminal characterized in that the above chained terminal is used, a pair of terminal crimping machines are arranged in positions in which they are separated by multiple times a pitch between adjacent connection terminals on both sides of the feed plate, and an electric wire is alternately crimped and fixed to each connection terminal on both sides of the feed plate by each terminal crimping machine, while feeding the chained terminal by a half of the pitch between adjacent connection terminals.

Further, the above object of the present invention is achieved by a crimping method of a chained terminal characterized in that the above chained terminal is used, a pair of terminal crimping machines are arranged in positions in which they are separated by odd number times a half of a pitch between adjacent connection terminals on both sides of the feed plate, and an electric wire is simultaneously crimped and fixed to each connection terminal on both sides of the feed plate by each terminal crimping machine, while feeding the chained terminal by the pitch between adjacent connection terminals.

DETAILED DESCRIPTION OF THE INVENTION

Referring to the accompanying drawings, a chained terminal and a crimping method according to an embodiment of the present invention will be described in detail below.

Figure 1:
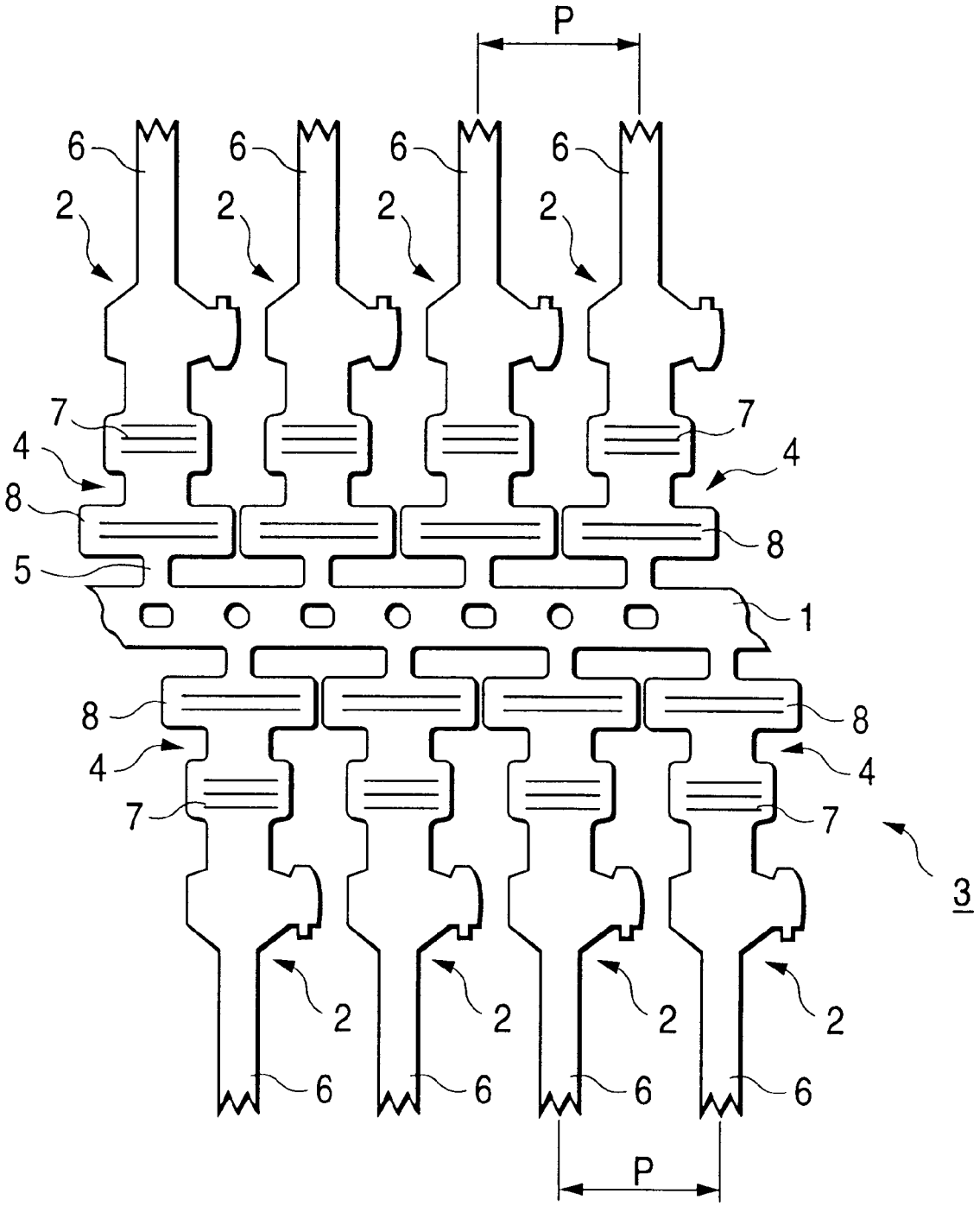
FIG. 1 is a plan view showing a state in which a chained terminal according to an embodiment of the present invention is developed.

FIG. 1 is a plan view showing a state in which a chained terminal 3 is developed.

In a terminal metallic part material of the chained terminal 3 made of a metallic thin plate through a press die (not shown), plural male terminals 2 are arranged at predetermined pitch P in a staggered layout on both sides of a long and narrow feed plate 1. That is, the male terminals 2 which are connection terminals arranged on one side of the feed plate 1 at the predetermined pitch P, are respectively located halfway between the male terminals 2 arranged on the other side of the feed plate 1 at the predetermined pitch P.

Figure 2:
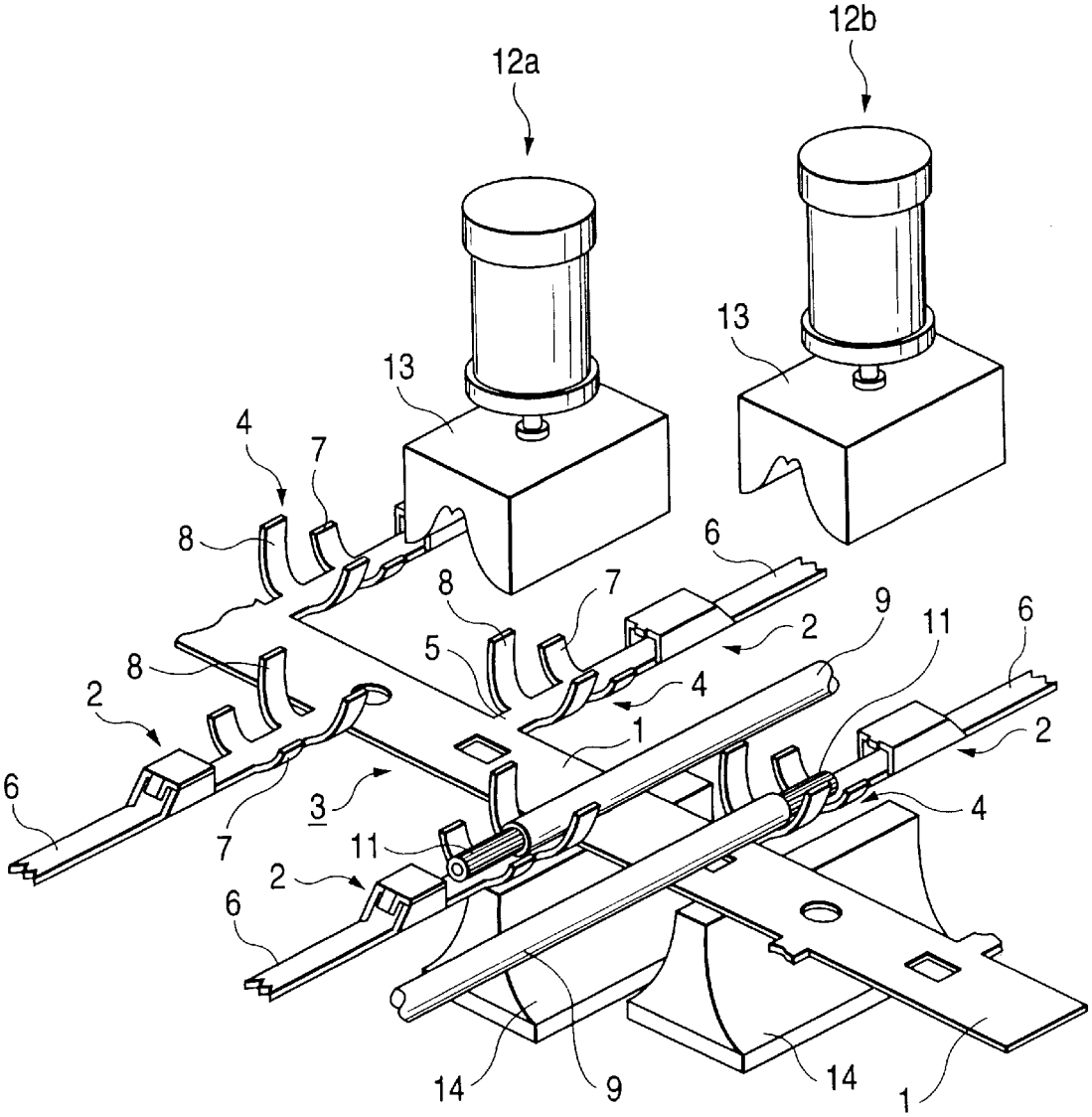
FIG. 2 is a schematic perspective view showing a process for crimping the chained terminal shown in FIG. 1 by a terminal crimping machine.

The above male terminal 2 consists of an electric wire connecting part 4 located on the side of the feed plate 1 and an electric contact part 6 is formed in the shape of a box in a preparatory process as shown in FIG. 2, and the chained terminal 3 wherein the core wire locking part 7 and the electric wire locking part 8 are bent approximately in a U-shape is fed to terminal crimping machine 12*a* and 12*b* by a not-shown feed mechanism.

The above terminal crimping machines 12*a* and 12*b* are arranged in positions in which they are separated by pitch P between adjacent male terminals 2 on both sides of the feed plate 1 of the chained terminal 3, and the terminal crimping machines 12*a* and 12*b* are provided with a crimping punch 13 and an anvil 14 which are opposite to crimp the male terminal 2 to the electric wire 9.

An electric wire supply apparatus (not shown) is arranged on the reverse side of the respective terminal crimping machines 12*a* and 12*b* with respect to the feed plate 1, and the electric wire 9 at the end of which a core wire 11 is exposed is supplied to the electric wire connecting part 4 of the male terminal 2 positioned between the crimping punch 13 and the anvil 14 of the respective terminal crimping machines 12*a* and 12*b*. At this time, since the respective male terminals 2 are arranged on both sides of the feed plate in a staggered layout, the male terminal 2 on the other side does not interfere with the electric wire 9 supplied from the electric wire supply apparatus on the other side to the male terminal 2 on one side.

In the respective male terminals 2 of the chained terminal 3 is fed to the terminal crimping machine 12*a* or 12*b* by the feed mechanism not shown, the electric wire 9 is crimped and fixed to the electric wire connecting part 4, a predetermined portion of a connecting part 5 to the feed plate 1 is cut, and the plural electric wires 9 are sequentially crimped and fixed to the respective male terminals 2.

That is, according to the above chained terminal 3 of the present invention, the male terminal 2 is respectively formed on both sides of the feed plate 1, the number of the feed plates 1 for the amount of production of the male terminal 2 is reduced by half in comparison with a conventional type chained terminal, and unnecessary material per a terminal is reduced. The size of a press die for punching the terminal metal material of the chained terminal 3 per a terminal is also reduced.

The terminal crimping machines 12*a* and 12*b* in the above embodiment are arranged in positions in which they are separated by the pitch P between adjacent male terminals 2, however, an interval between these terminal crimping machines 12*a* and 12*b* may be multiple times the pitch P between the male terminals 2, so that an interval between the terminal crimping machines 12*a* and 12*b* along the feed plate 1 may be increased.

Next, referring to schematic explanatory views of FIGS. 3 to 5, a method of crimping the above chained terminal 3 according to the present invention will be described.

Figure 3:
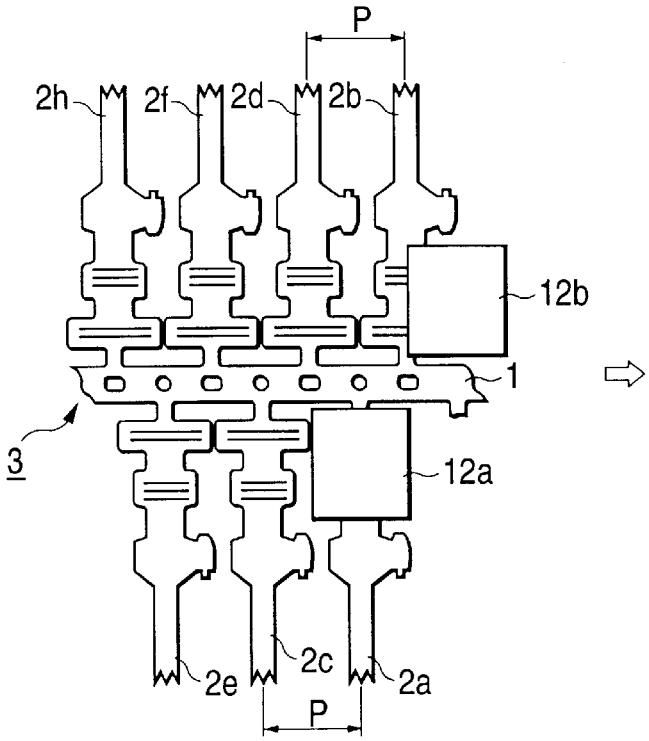
FIG. 3 is a schematic explanatory view for explaining the crimping method of the chained terminal.

As shown in FIG. 3, a pair of terminal crimping machines 12*a* and 12*b* are arranged in positions in which they are separated by pitch P between adjacent male terminals 2 on both sides of the feed plate 1 of the chained terminal 3.

In the chained terminal 3, male terminals 2*b*, 2*d*, 2*f*, 2*h* and the following are arranged at predetermined pitch P on one side (on the upper side in FIG. 3) of the feed plate 1 as described above and male terminals 2*a*, 2*c*, 2*e* and the following are also arranged at the predetermined pitch P on the other side so that they and the above male terminals 2*b*, 2*d*, 2*f*, 2*h* and the following constitute a staggered layout.

First, the electric wire 9 the core wire 11 of which is exposed is supplied to the electric wire connecting part 4 of the above male terminal 2*a* located under the terminal crimping machine 12*a* by the electric wire supply apparatus not shown. The core wire 11 and the coated part of the electric wire 9 are locked in the core wire locking part 7 and the electric wire locking part 8 by the above terminal crimping machine 12*a*, the electric wire 9 is crimped and fixed to the electric wire connecting part 4 of the male terminal 2*a*, and the male terminal 2*a* is cut from the feed plate 1.

Figure 4:
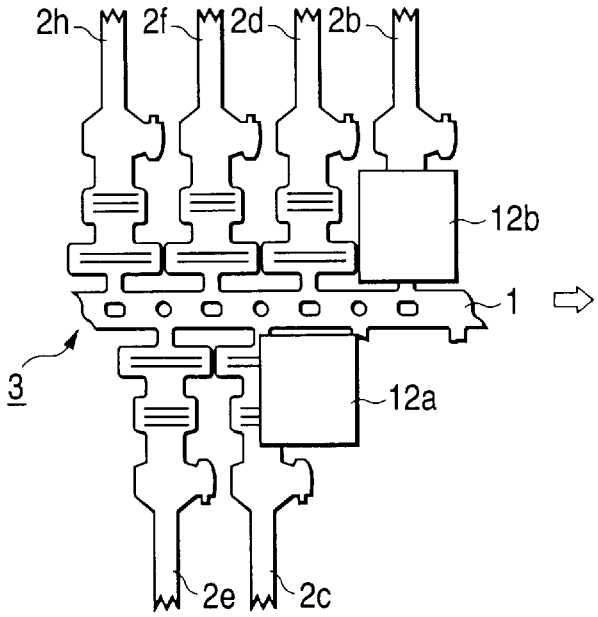
FIG. 4 is a schematic explanatory view for explaining the crimping method of the chained terminal.

Next, the chained terminal 3 is fed by the half of the above pitch P by the feed mechanism not shown and since the above male terminal 2*b* is located under the terminal crimping machine 12*b* as shown in FIG. 4, the electric wire 9 the core wire 11 of which is exposed is supplied to the electric wire connecting part 4 of the male terminal 2*b* by the electric wire supply apparatus not shown. The core wire 11 and the coated part of the electric wire 9 are locked in the core wire locking part 7 and the electric wire locking part 8 by the above terminal crimping machine 12*b*, the electric wire 9 is crimped and fixed to the electric wire connecting part 4 of the male terminal 2*b*, and the male terminal 2*b* is cut from the feed plate 1.

Figure 5:
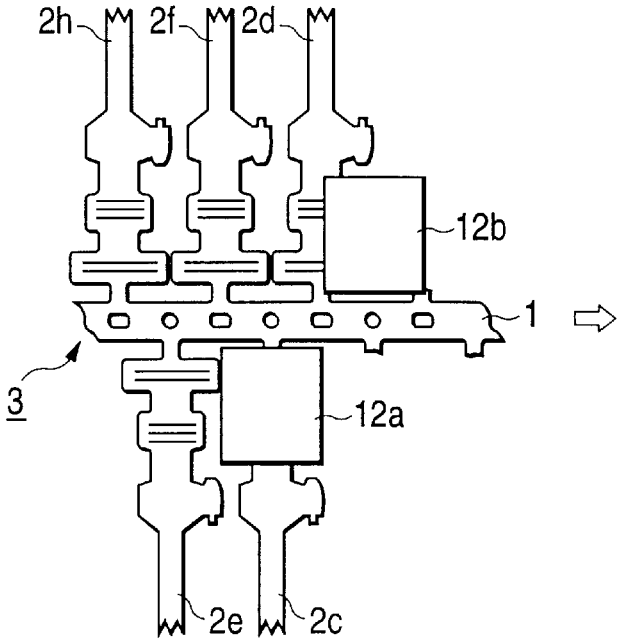
FIG. 5 is a schematic explanatory view for explaining the crimping method of the chained terminal.

The chained terminal 3 is fed by the half of the above pitch P by the feed mechanism not shown, the above male terminal 2*c* is located under the terminal crimping machine 12*a* as shown in FIG. 5, the electric wire 9 is crimped and fixed to the electric wire connecting part 4 like the case of the male terminal 2*a*, and the male terminal 2*c* is cut from the feed plate 1.

As described above, the electric wire 9 is alternately crimped and fixed to each male terminal 2*a*, 2*b*, 2*c*, 2*d* and the following on both sides of the feed plate 1 by each terminal crimping machine 12*a* or 12*b*, while feeding the chained terminal 3 by the half of the pitch P by the feed mechanism not shown.

That is, according to the above crimping method of the chained terminal 3 according to the present invention, the number of electric wires 9 crimped and fixed to each male terminal 2 while feeding the feed plate 1 is twice as many as that of a conventional type chained terminal, and production quantity per unit time can be doubled.

Further, since the feed pitch of the feed plate 1 using the chained terminal 3 is the half of the pitch P between the male terminals 2, a feed error of the feed mechanism is also reduced. Therefore, even if the feed rate of the terminal feed mechanism is increased, a feed by the terminal feed mechanism is prevented from being imprecise, the male terminal 2 is prevented from failing to be crimped to the electric wire 9, and the male terminal is prevented from being damaged.

Therefore, since the feed rate of the terminal feed mechanism can be speeded up and the terminal crimping machines 12*a* and 12*b* can be operated at high speed, productive efficiency can be enhanced.

Next, referring to schematic explanatory views of FIGS. 6 and 7, another crimping method of the chained terminal 3 according to the present invention will be described.

Figure 6:
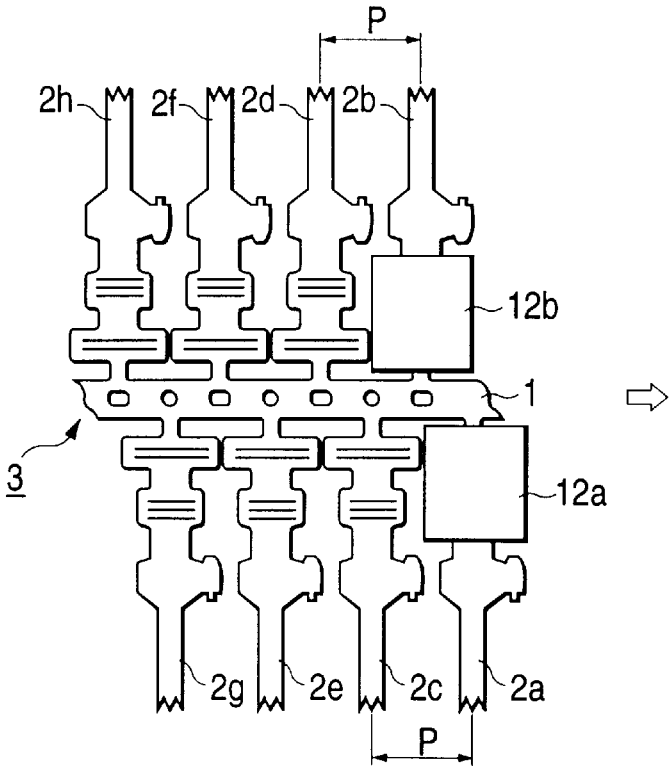
FIG. 6 is a schematic explanatory view for explaining another crimping method of the chained terminal.

As shown in FIG. 6, a pair of terminal crimping machines 12*a* and 12*b* are arranged in positions in which they are separated by the half of the pitch P between adjacent male terminals 2 on both sides of the feed plate 1 of the chained terminal 3.

In the above chained terminal 3, male terminals 2*b*, 2*d*, 2*f*, 2*h* and the following are arranged at predetermined pitch P on one side (on the upper side in FIG. 6) of the feed plate 1 and male terminals 2*a*, 2*c*, 2*e* and the following are also arranged at the predetermined pitch P on the other side (on the lower side in FIG. 6) so that they and the above male terminals 2*b*, 2*d*, 2*f*, 2*h* and the following constitute a staggered layout.

First, the electric wire 9 the core wire 11 of which is exposed is simultaneously supplied to each electric wire connecting part 4 of the above male terminals 2*a* and 2*b* respectively located under the terminal crimping machines 12*a* and 12*b* by the electric wire supply apparatus not shown. The core wire 11 and the coated part of each electric wire 9 are locked in the respective core wire locking parts 7 and the respective electric wire locking parts 8 by the above terminal crimping machines 12*a* and 12*b*, the electric wire 9 is crimped and fixed to the respective electric wire connecting parts 4 of the male terminals 2*a* and 2*b*, and the male terminals 2*a* and 2*b* are respectively cut from the feed plate 1.

Figure 7:
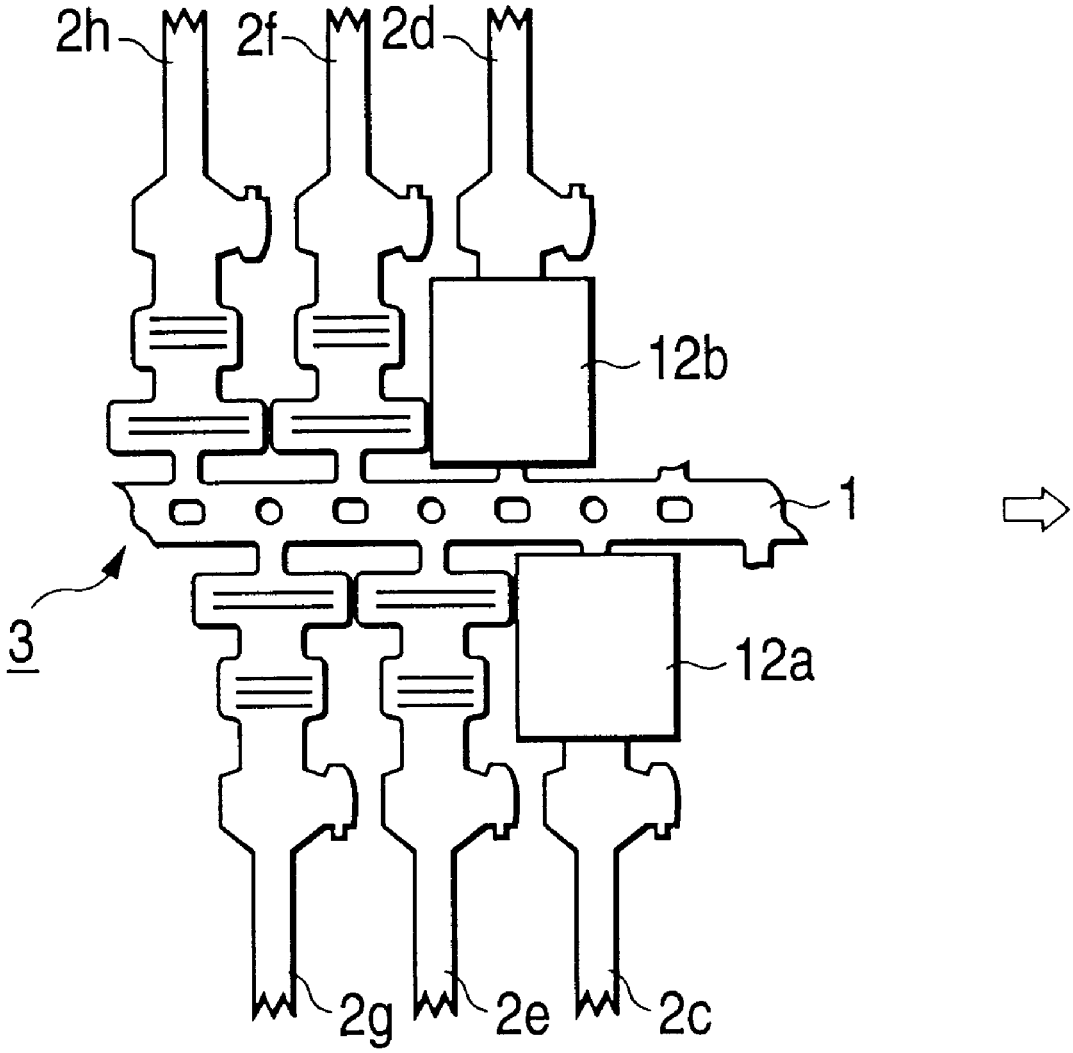
FIG. 7 is a schematic explanatory view for explaining the another crimping method of the chained terminal.

Next, the chained terminal 3 is fed by a pitch equal to the above pitch P by the feed mechanism not shown and since the above male terminals 2*c* and 2*d* are respectively located under the terminal crimping machines 12*a* and 12*b* as shown in FIG. 7, the electric wire 9 the core wire of which is exposed is simultaneously supplied to each electric wire connecting part 4 of these male terminals 2*c* and 2*d* by the electric wire supply apparatus not shown. The core wire 11 and the coated part of each electric wire 9 are locked in the respective core wire locking parts 7 and the respective electric wire locking parts 8 by the above terminal crimping machines 12*a* and 12*b*, the electric wire 9 is crimped and fixed to the respective electric wire connecting parts 4 of the male terminals 2*c* and 2*d*, and the male terminals 2*c* and 2*d* are respectively cut from the feed plate 1.

As described above, a pair of electric wires 9 are simultaneously crimped and fixed to the male terminal 2*a*, 2*b*, 2*c*, 2*d* and the following on both sides of the feed plate 1 by the respective terminal crimping machines 12*a* and 12*b*, while feeding the chained terminal 3 by the same pitch as the above pitch P by the feed mechanism not shown.

That is, according to the above crimping method of the chained terminal 3 according to the present invention, the number of electric wires 9 crimped and fixed to each male terminal 2 while feeding the feed plate 1 is twice as many as that of a conventional type chained terminal, and production quantity per unit time can be doubled without increasing the feed rate of the terminal feed mechanism.

The terminal crimping machines 12*a* and 12*b* in the above embodiment are arranged in positions in which they are separated by the half of the pitch P between adjacent male terminals 2, however, an interval between these terminal crimping machines 12*a* and 12*b* may be odd number times the half of the pitch P between the male terminals 2, so that the interval between the terminal crimping machines 12*a* and 12*b* along the feed plate 1 may be increased according to the machine layout.

In the above embodiment, the male terminal 2 is used for a connection terminal formed in the chained terminal 3, however, it need scarcely be said that another connection terminal such as a female terminal and a terminal for PCB may be formed in the chained terminal according to the present invention, and the form of each connection terminal may be also variously formed.

As described above, according to the chained terminal according to the present invention, plural connection terminals are formed on both sides of the feed plate, so that the number of the feed plates for the production quantity of the connection terminals is reduced by half in comparison with a conventional type chained terminal, and unnecessary material per one terminal is reduced. The size of a press die for punching the terminal metal material of the chained terminal per one terminal is also reduced.

Also, according to the crimping method of the chained terminal according to the present invention, the number of electric wires crimped and fixed to each connection terminal while feeding the feed plate is twice as many as that of a conventional type chained terminal, so that production quantity per unit time can be doubled.

Further, since the feed pitch of the feed plate using the chained terminal can be reduced up to the half of the pitch between the connection terminals, the feed error of the terminal feed mechanism is also reduced. Therefore, even if the feed rate of the terminal feed mechanism is increased, a feed by the terminal feed mechanism is prevented from being imprecise, the connection terminal is positively crimped to an electric wire, and is prevented from being damaged. Therefore, since the feed rate of the terminal feed mechanism can be increased and the terminal crimping machine can be operated at high speed, productive efficiency can be enhanced.

What is claimed is:

1. A crimping method of a chained terminal, comprising the steps of:

preparing a chained terminal having a feed plate and a plurality of connection terminals arranged on one side of said feed plate at a predetermined pitch and located approximately halfway between connection terminals arranged on the opposite side of said feed plate at said predetermined pitch, each of said connection terminals including an electric contact part and an electric wire connecting part;

arranging a pair of terminal crimping machines in positions in which said pair of terminal crimping machines are separated from each other by a multiple of a pitch between adjacent ones of said connection terminals on both sides of said feed plate; and alternately crimping and thus fixing an electric wire to a corresponding connection terminal on both sides of said feed plate by each of said terminal crimping machines at each time when said chained terminal is fed by a half of the pitch between adjacent ones of said connection terminals.

* * * * *